US011056831B2

(12) United States Patent
Mamiya et al.

(10) Patent No.: US 11,056,831 B2
(45) Date of Patent: Jul. 6, 2021

(54) CONNECTOR

(71) Applicant: Sumitomo Wiring Systems, Ltd., Yokkaichi (JP)

(72) Inventors: Yuma Mamiya, Yokkaichi (JP); Shinjiro Kida, Yokkaichi (JP)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 16/911,624

(22) Filed: Jun. 25, 2020

(65) Prior Publication Data

US 2020/0412056 A1 Dec. 31, 2020

(30) Foreign Application Priority Data

Jun. 27, 2019 (JP) ..... JP2019-119710

(51) Int. Cl.
*H01R 13/639* (2006.01)
*H01R 13/422* (2006.01)

(52) U.S. Cl.
CPC ..... *H01R 13/639* (2013.01); *H01R 13/4226* (2013.01)

(58) Field of Classification Search
CPC ..... H01R 13/6272; H01R 13/641; H01R 13/422; H01R 13/39
See application file for complete search history.

(56) References Cited

U.S. PATENT DOCUMENTS 6,022,238 A 2/2000 Tomita et al.

FOREIGN PATENT DOCUMENTS

JP 10-199622 7/1998

*Primary Examiner* — Briggitte R. Hammond
(74) *Attorney, Agent, or Firm* — Gerald E. Hespos; Michael J. Porco; Matthew T. Hespos

(57) ABSTRACT

It is aimed to provide a connector capable of ensuring lock reliability. A connector includes a detector allowed to move from a standby position to a detection position after both housings are connected. The detector includes a locking piece to be locked to a lock arm at the standby position before the housings are connected. The lock arm of the housing includes a releasing portion to be pressed at the time of separating the housings, a stopper contactable by the detector having reached the detection position at a position facing the releasing portion, two links linking the releasing portion and the stopper and facing each other, and an insertion hole formed inside the releasing portion, the stopper and the links, the locking piece being inserted into the insertion hole.

8 Claims, 9 Drawing Sheets

CONNECTOR

BACKGROUND

Field of the Invention

This disclosure relates to a connector.

Related Art

Japanese Unexamined Patent Publication No. H10-199622 discloses a female connector and a male connector that are connectable to each other. The female connector includes a female connector housing and a double locking member movably mounted into the female connector housing. The double locking member is fit and partially locked in the female connector housing, and fully locked to the female connector housing with the female connector and the male connector connected. The female connector housing has a deflectable lock arm with a space that receives a lock of the double locking member. The lock arm also has an engaging projection in front of the space. A movement of the double locking member to a full locking position is restricted by the contact of the lock with the engaging projection.

The space is open in rear, upper and lower surfaces in a rear part of the lock arm. Thus, if the female connector housing is reduced in size, there is a concern that the strength of the lock arm is reduced. Locking the connectors in a connected state is less reliable if the strength of the lock arm is insufficient.

Accordingly, it is aimed to provide a connector capable of ensuring lock reliability.

SUMMARY

This disclosure is directed to a connector with a housing that is connectable to a mating housing. A deflectable lock arm is provided on the housing and can lock the mating housing in a connected state. A detector is movable between a standby position and a detection position with respect to the housing and can move from the standby position to the detection position after the housings are connected. The detector includes a locking piece to be locked to the lock arm at the standby position before the housings are connected, and the lock arm includes a releasing portion to be pressed when separating the housings. A stopper can be contacted by the detector that has reached the detection position at a position facing the releasing portion. Two links face each other and link the releasing portion to the stopper. An insertion hole is formed inside the releasing portion, the stopper and the links, and the locking piece can be inserted into the insertion hole.

The lock arm includes the insertion hole into which the locking piece of the detector is inserted. Thus, it is difficult to ensure the strength of the lock arm. However, the insertion hole is formed inside the releasing portion, the stopper and the two links that constitute the lock arm. Thus, the strength of the lock arm easily is obtained and lock reliability can be ensured, as compared to the conventional lock arm with no part equivalent to the stopper. Further, the releasing portion can be pressed when separating the housings, the stopper can be contacted by the detector that has reached the detection position, and the links are parts linking the releasing portion and the stopper. This can make the structure of the housing simpler and can contribute to a size reduction as compared to the case where a reinforcing portion for ensuring strength is merely provided.

The releasing portion, the stopper and the two links may be configured as a quadrilateral frame surrounding the insertion hole. According to this configuration, the strength of the lock arm can be improved.

The lock arm may include a leg rising from a body of the housing, and the stopper portion may be connected to the leg. According to this configuration, the strength of the stopper can be enhanced, and the structure of the housing can be made even simpler.

The detector may slide in contact with a part of the housing other than the lock arm to guide a movement of the detector. According to this configuration, even if the detector accidentally moves, a movement of the lock arm following the detector can be prevented. As a result, a locking state of the lock arm cannot be released inadvertently.

The detector may include a wall at a position side by side with the releasing portion in a moving direction from the standby position to the detection position. The wall may have an end surface at a position higher than the releasing portion in a height direction intersecting the moving direction. The releasing portion can be prevented from being accidentally pressed by external matter since the external matter contacts the end surface of the wall. As a result, it can be more reliably prevented that the locking state of the lock arm is not released inadvertently.

A specific example of the connector is described below with reference to the drawings. Note that the invention is not limited to these illustrations and is intended to be represented by claims including all changes in the scope of claims and in the meaning and scope of equivalents.

The connector of this disclosure ensures lock reliability.

DETAILED DESCRIPTION

A connector includes a housing 10 and a detector 60. The housing 10 is connectable to a mating housing 90. Note that, in the following description, surface sides facing each other when the connection of the housings 10, 90 is started are referred to as front sides concerning a front-rear direction. A vertical direction is based on figures except FIGS. 4 and 8.

<Housing 10>

Figure 1:
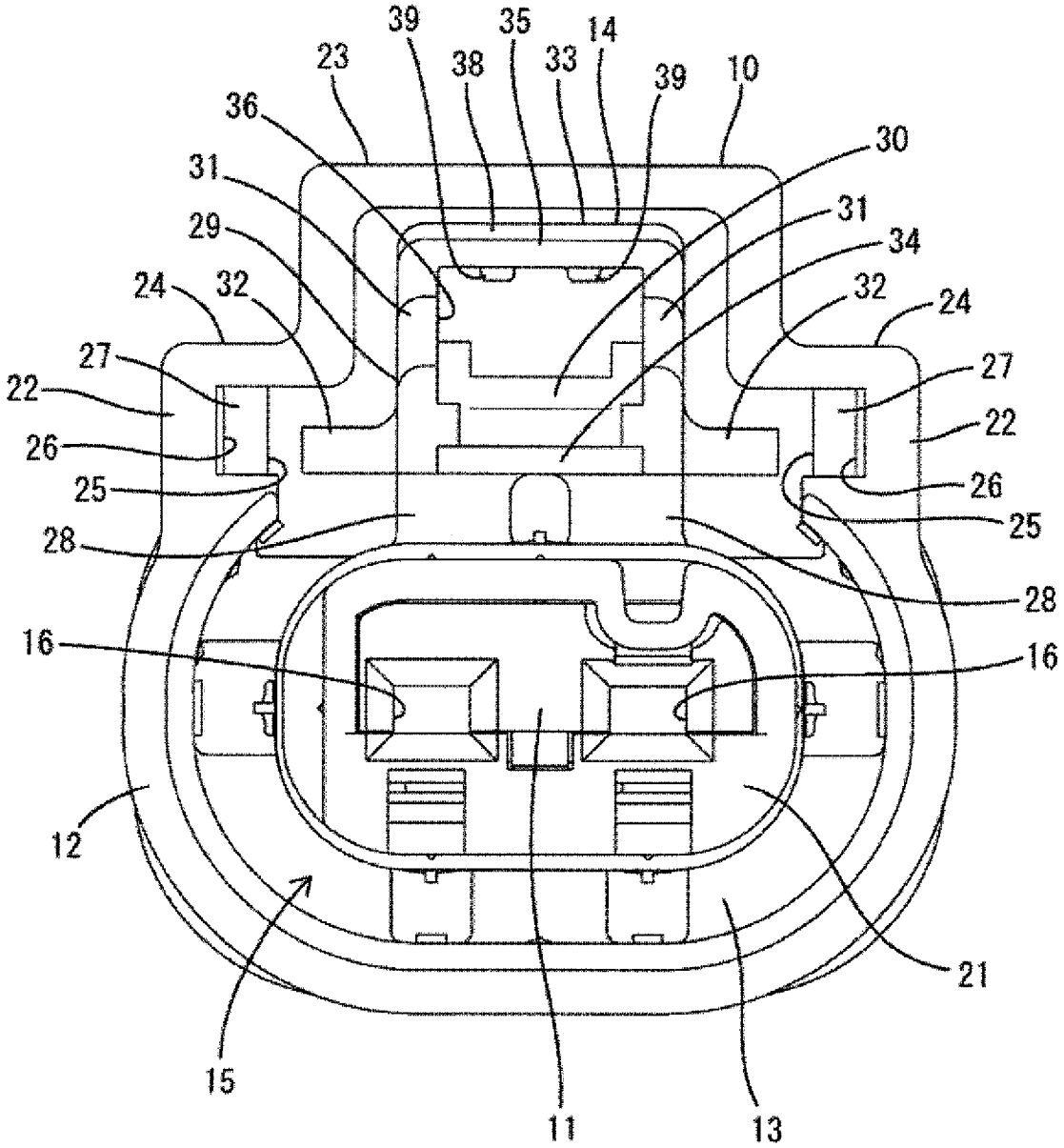
FIG. 1 is a front view of a housing having a front retainer mounted therein in a connector according to one embodiment.
Figure 6:
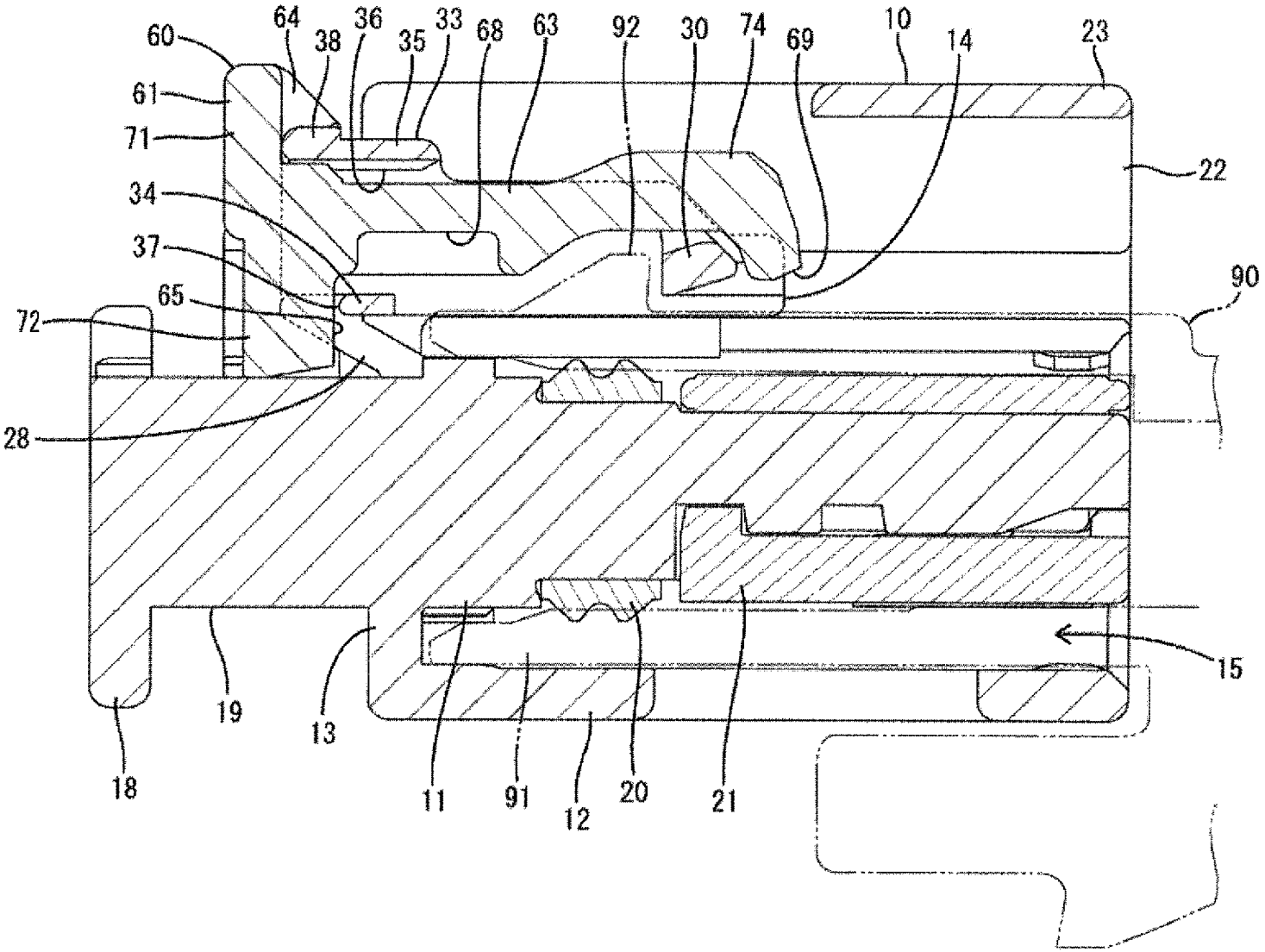
FIG. 6 is a side view in section showing a state where the housing is connected to a mating housing and the detecting member has reached a detection position.
Figure 7:
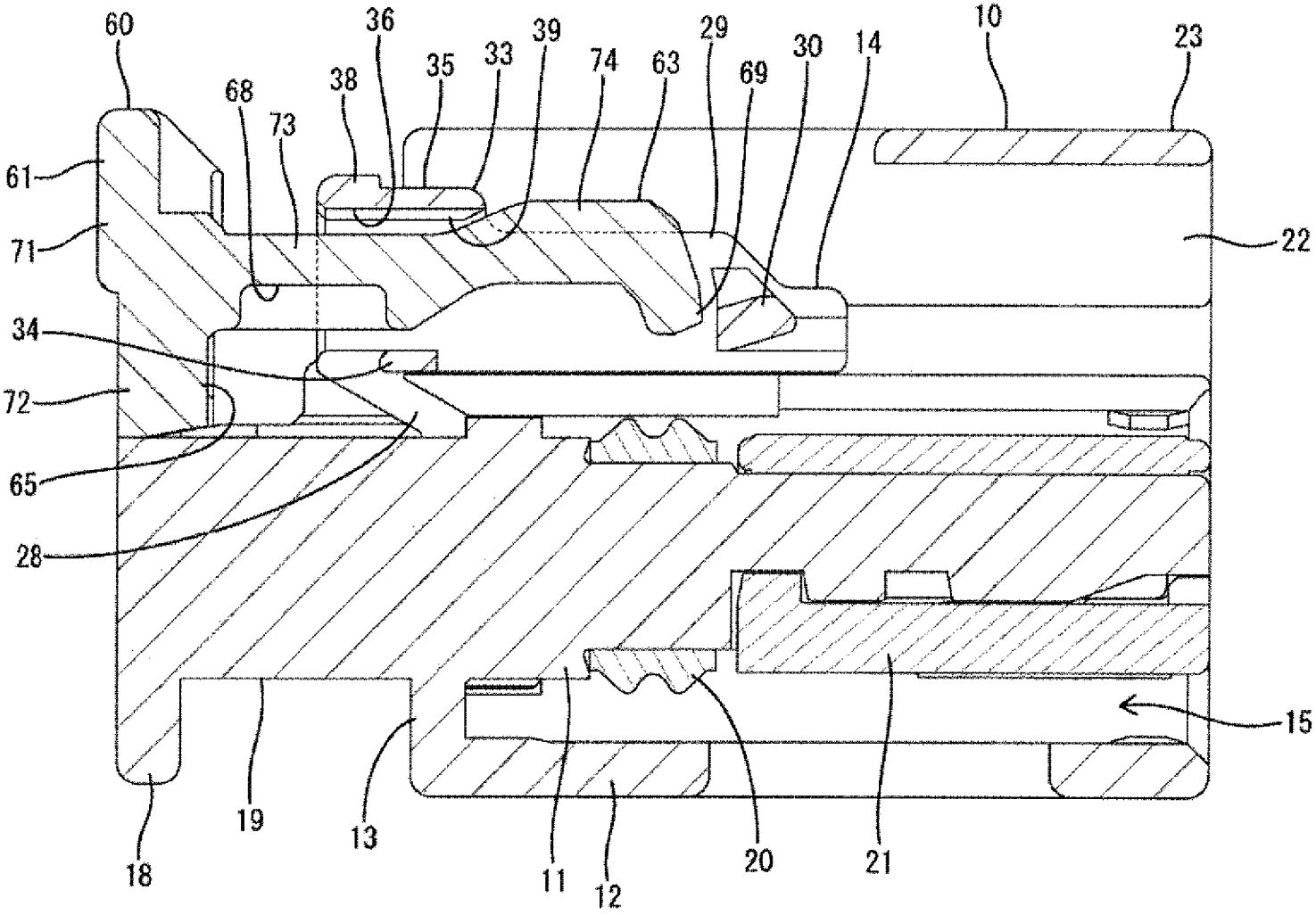
FIG. 7 is a side view in section showing a state where the detecting member is held at a standby position with respect to the housing.

The housing 10 is made of synthetic resin and includes, as shown in FIGS. 1 and 7, a housing body 11, a fitting tube 12 surrounding the outer periphery of the housing body 11, a coupling 13 radially extending and linking the housing body 11 and the fitting tube 12, and a lock arm 14 provided above the housing body 11. A space between the housing body 11 and the fitting tube 12 and forward of the coupling 13 serves as a fitting space 15 into which a later-described receptacle 91 (see FIG. 6) of the mating housing 90 is fit.

Figure 2:
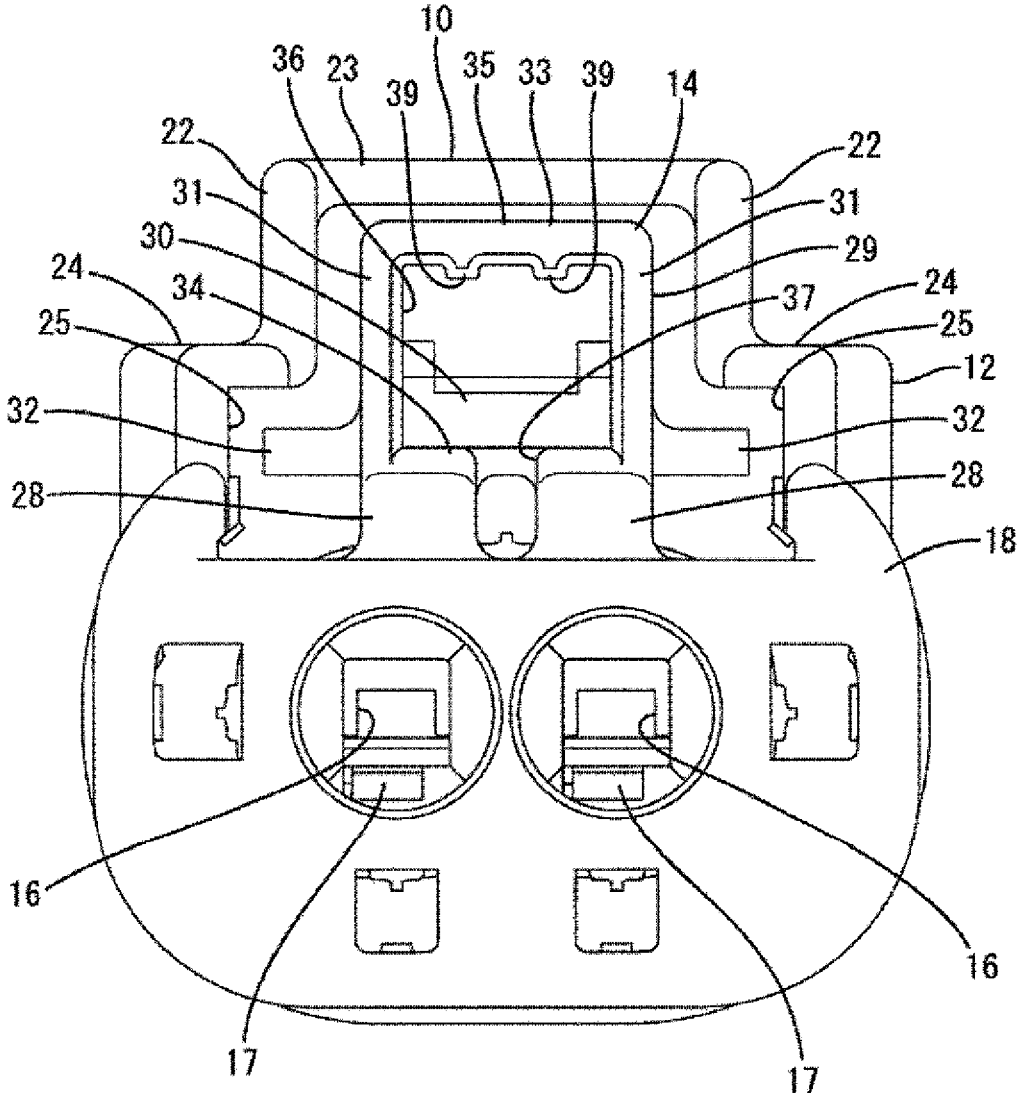
FIG. 2 is a back view of the housing.

Cavities 16 penetrate the housing body 11 in the front-rear direction. The cavities 16 are provided laterally side by side in the housing body 11. As shown in FIG. 2, deflectable locking lances 17 are at the lower surfaces of the cavities 16. Unillustrated terminal fittings are inserted into the respective cavities 16 from behind and are locked by the locking lances 17 and retained in the cavities 16 of the housing body 11.

A flange 18 protrudes radially on a rear part of the housing body 11. As shown in FIG. 7, a mounting groove 19 is provided circumferentially between the flange 18 and the coupling 13 on the outer peripheral surface of the housing body 11 and can receive an unillustrated cover.

An annular sealing member 20 is fit on the outer peripheral surface of the housing body 11. The sealing member 20 is made of rubber, such as silicon rubber, and is in contact with a step in front of the coupling 13. The sealing member 20 is radially compressed between the receptacle 91 and the housing body 11 when the housings 10, 90 are connected. The sealing member 20 seals the housings 10, 90 in a liquid-tight manner.

As shown in FIG. 7, a front retainer 21 is mounted into the housing body 11 from the front. The front retainer 21 is made of synthetic resin, covers the front surface of the housing body 11 and functions to restrict forward escape of the sealing member 20 and the deflection of the locking lances 17. The front retainer 21 secondarily retains the terminal fittings by restricting deflection of the locking lances 17.

As shown in FIGS. 1 and 2, the fitting tube 12 includes, in an upper part, two side walls 22 arranged along vertically on both left and right sides of the lock arm 14 and an upper wall 23 extending between the upper ends of the side walls 22 above the lock arm 14.

Figure 8:
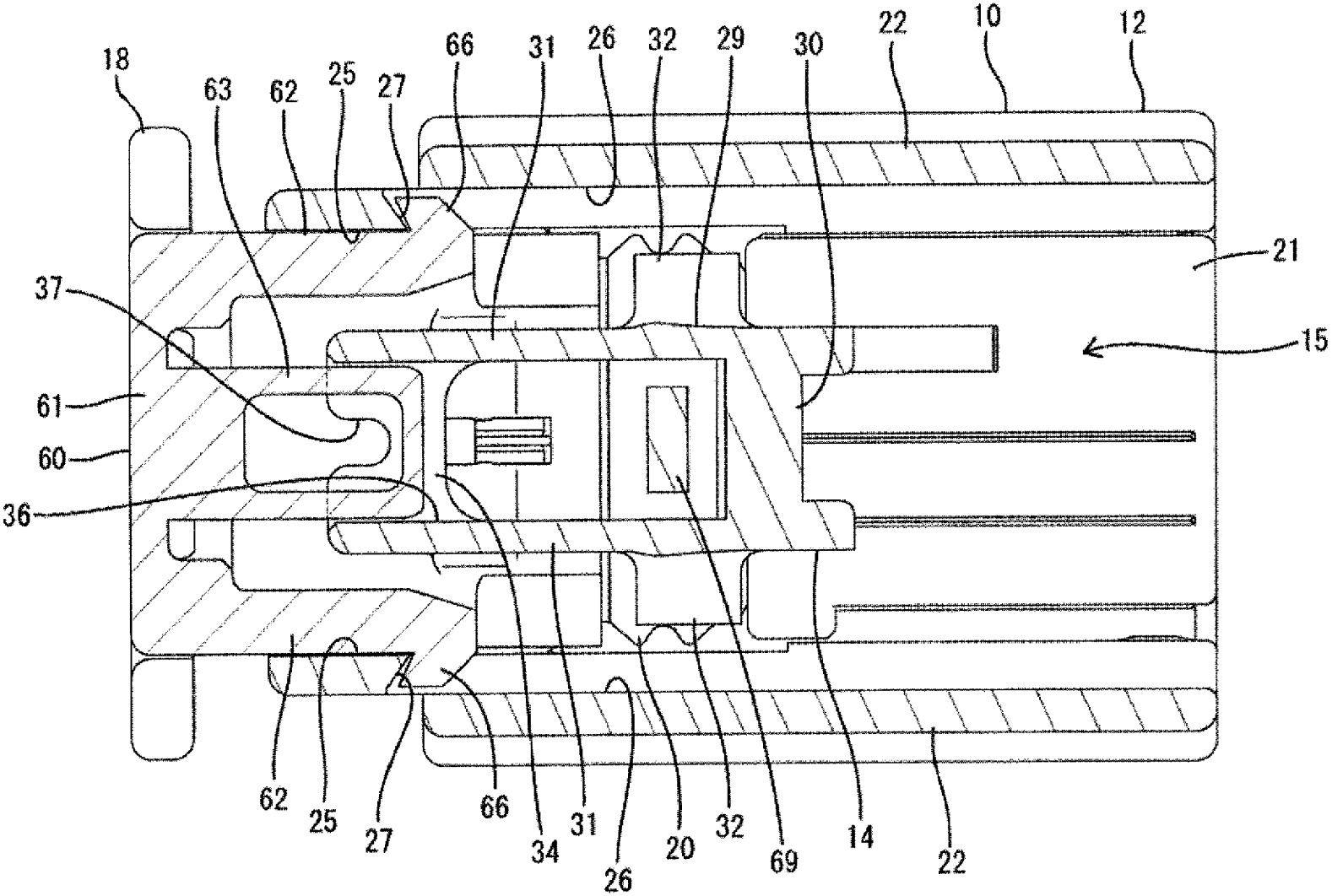
FIG. 8 is a plan view in section showing the state where the detecting member is held at the standby position with respect to the housing.

As shown in FIG. 8, the side walls 22 are formed from the front end of the housing 10 to positions near a rear end. As shown in FIGS. 1 and 2, the side walls 22 include steps 24 extending along a lateral direction in vertically intermediate parts. Grooves 25 penetrate the side walls 22 in the front-rear direction in inner surface regions below the steps 24. As shown in FIG. 8, forwardly open retaining grooves 26 extend in the front-rear direction and are provided by recessing the inner surfaces of the grooves 25 of the side walls 22, and retaining surfaces 27 tapered and inclined forward are formed on the rear ends of the retaining grooves 26.

As shown in FIG. 7, the upper wall 23 is connected to front parts of the upper ends of the side walls 22. The lock arm 14 is arranged behind the upper wall 23 and can be confirmed visually in a plan view.

The lock arm 14 includes left and right legs 28 rising from the upper surface of the housing body 11, as shown in FIGS. 1 and 2, and an arm body 29 extends forward from the upper ends of the legs 28, as shown in FIG. 7. The legs 28 are inclined rearwardly from the upper surface of the housing body 11 to the upper ends.

As shown in FIG. 8, the arm body 29 includes a locking portion 30 extends laterally along on a front part of the arm body 29 and two links 31 extend in the front-rear direction on both left and right sides of the locking portion 30. The links 31 are vertical plates extending along the front-rear directions. Front parts of the links 31 are connected to both left and right ends of the locking portion 30, as shown in FIG. 1, and rear parts thereof are connected to the legs 28, as shown in FIG. 2. Protruding portions 32 protrude left and right on lower parts of outer surfaces of the links 31 near front ends. As shown in FIG. 8, the protruding portions 32 are rectangular plates that face the retaining grooves 26 of the side walls 22.

Figure 9:
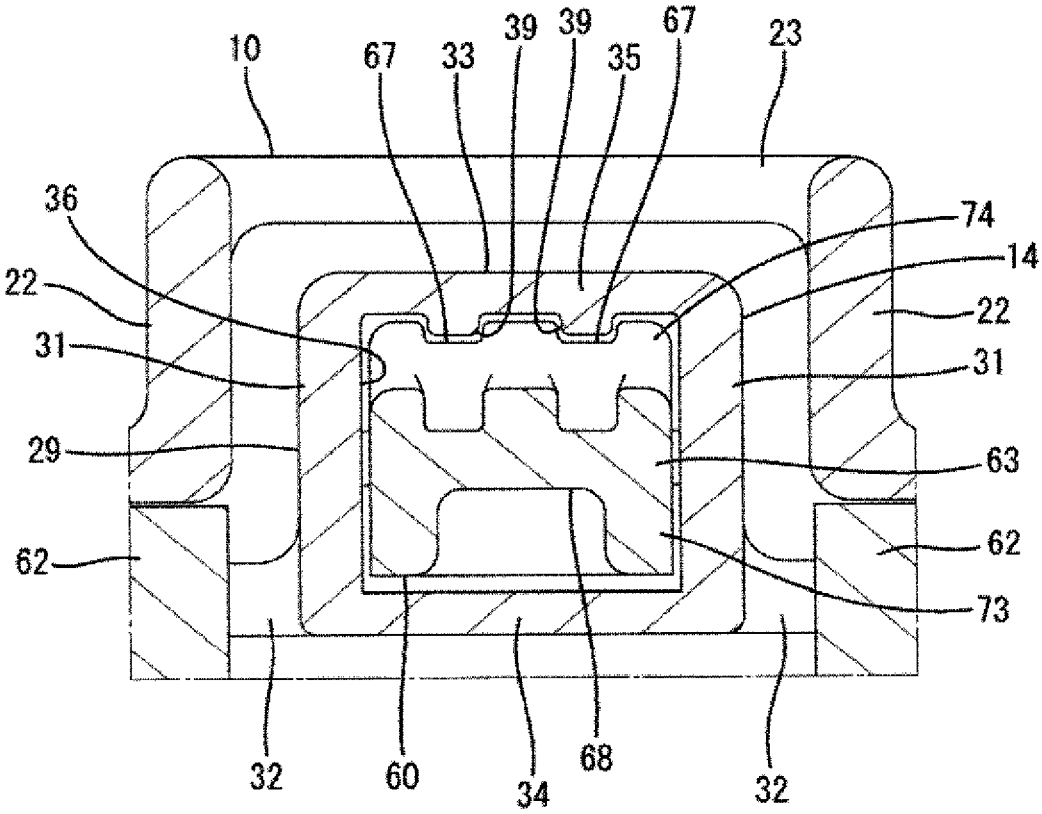
FIG. 9 is an enlarged transverse section showing a state where a locking piece of the detecting member is inserted in an insertion hole of a lock arm.
Figure 10:
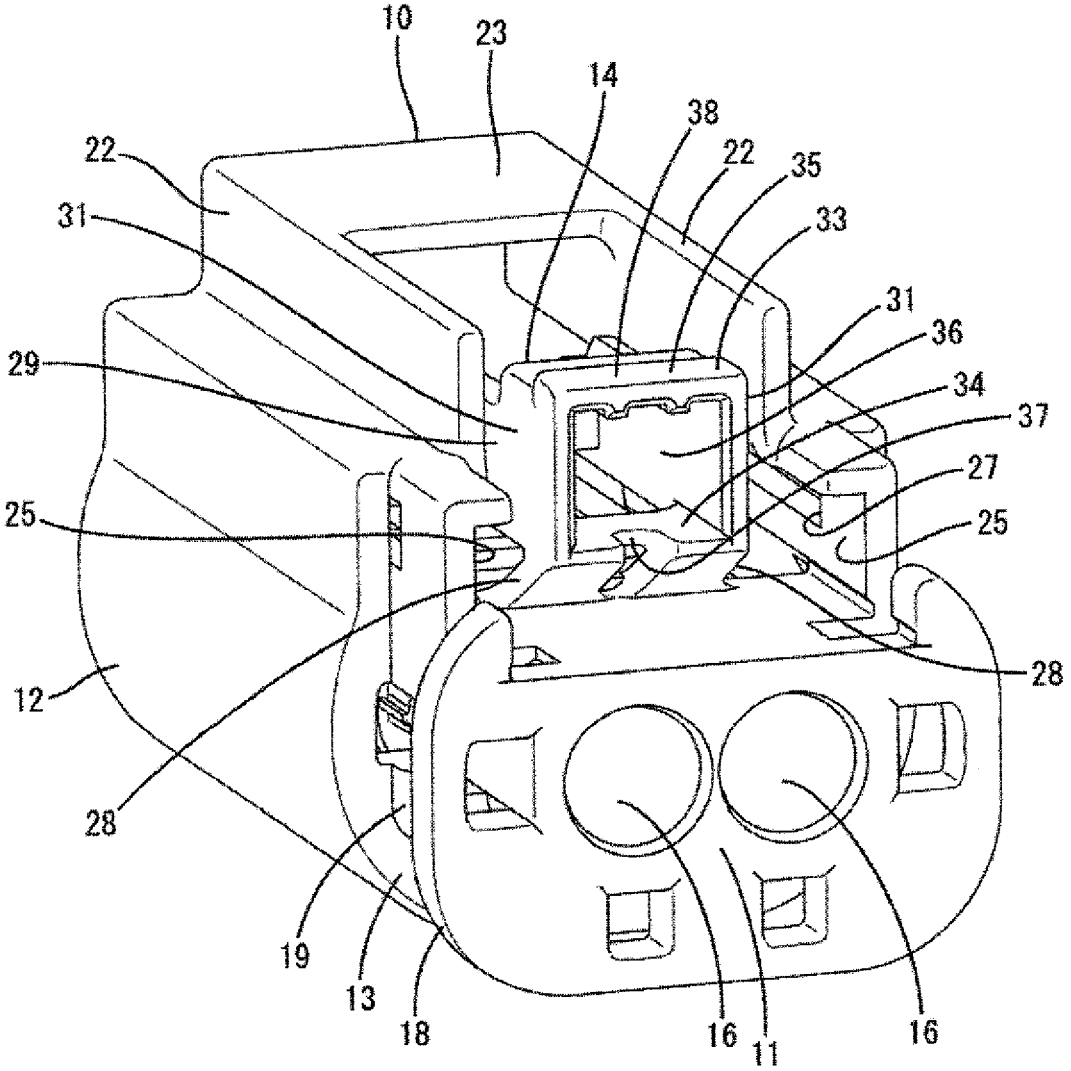
FIG. 10 is a perspective view of the housing.

As shown in FIGS. 2, 9 and 10, a rear part of the arm body 29 includes a rectangular frame 33. The frame 33 includes a stopper 34 laterally extending between the upper ends of the legs 28 and a releasing portion 35 arranged to face the stopper 34 above the stopper 34. The stopper 34 and the releasing portion 35 are plates extending along the front-rear and lateral directions. Both left and right ends of the stopper 34 are connected to the lower ends of rear end parts of the links 31. Left and right ends of the releasing portion 35 are connected to the upper ends of the rear parts of the links 31. The releasing portion 35 is higher than other areas in the arm body 29.

As shown in FIG. 8, the arm body 29 includes an insertion hole 36 behind the locking portion 30 and between the linking portions 31. The insertion hole 36 penetrates through the frame 33 in the front-rear direction and is open upward and downward between the locking portion 30 and the frame 33. A later-described locking piece 63 of the detector 60 is inserted into the insertion hole 36 from behind.

The upper surface of the stopper 34 is a flat surface at the same height as the lower surface of the locking portion 30 or at a position below the lower surface of the locking portion 30 in the vertical direction. As shown in FIG. 8, the rear end of the stopper 34 includes a recess 37 located at a position between the legs 28 in the lateral direction and cut into a U shape.

The upper surface of the releasing portion 35 is a flat surface exposed upward and includes a rib-like protrusion 38 extending in the lateral direction in a rear part. As shown in FIG. 7, the protrusion 38 is at a position overlapping the upper ends of the legs 28 in the front-rear direction and behind the lower ends of the legs 28. If the upper surface of the releasing portion 35 is pressed, the arm body 29 is inclined to displace the locking portion 30 up with the both legs 28 as fulcrums. Left and right ridges 39 are provided on the lower surface of the releasing portion 35. As shown in FIGS. 1 and 7, the ridges 39 are in the form of ribs extending in the front-rear direction and having a trapezoidal cross-sectional shape.

<Detector 60>

Figure 3:
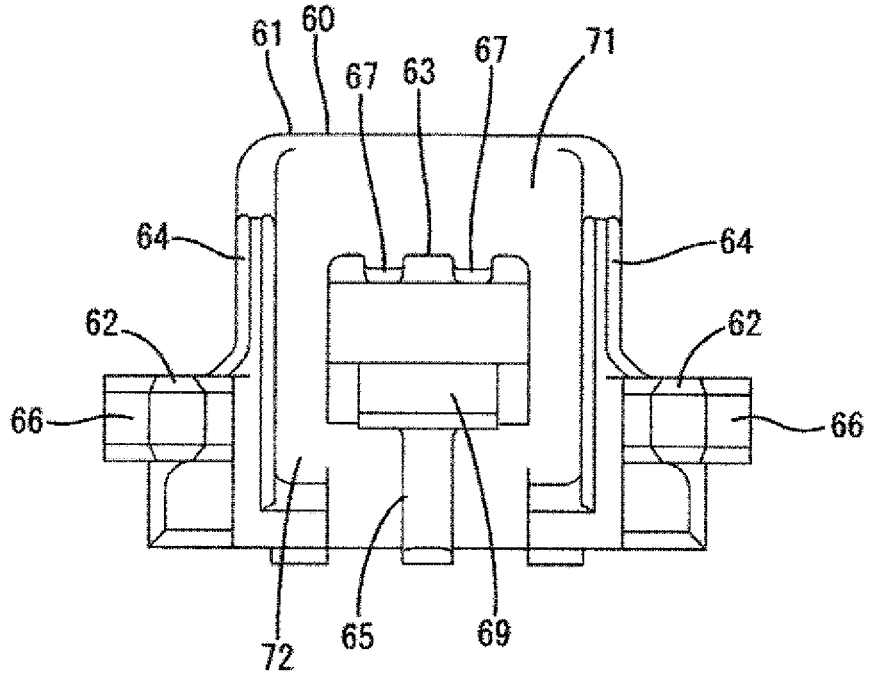
FIG. 3 is a front view of a detecting member.
Figure 4:
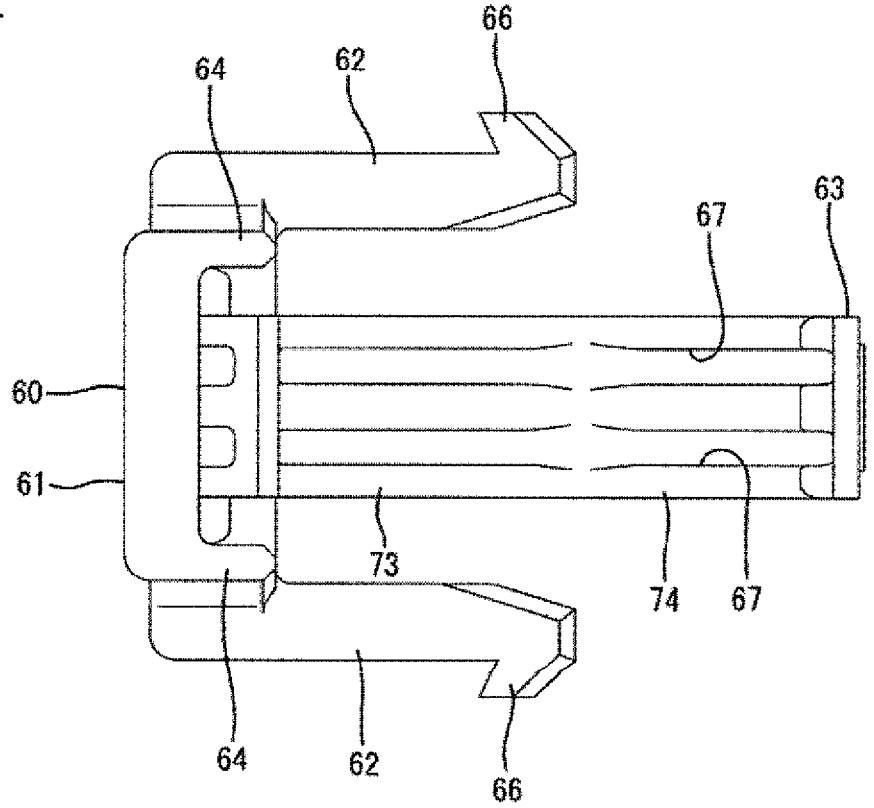
FIG. 4 is a plan view of the detecting member.

The detector 60 is made of synthetic resin and includes, as shown in FIGS. 3 and 4, a wall 61 extending along the lateral direction, two retaining pieces 62 projecting forward from both left and right ends of the wall 61 and the locking piece 63 projecting forward from a laterally intermediate part of the wall 61. The detector 60 is arranged with respect to the housing 10 movably in the front-rear direction to a standby position where the wall 61 is arranged behind and at a distance from the frame 33, as shown in FIG. 7, and a detection position where the wall 61 is at a position capable of contacting the frame 33, as shown in FIG. 6.

The wall 61 is vertical wall and is dimensioned to cover a rear region between the side walls 22. An upper part 71 of the wall 61 is a rectangular plate and faces the frame 33 from behind. As shown in FIG. 3, the upper part 71 of the wall 61 includes two projecting pieces 64 projecting forward from both left and right ends. The projecting pieces 64 extend in the vertical direction along the left and right ends of the upper part 71 of the wall 61.

Both left and right ends of a lower part 72 of the wall 61 protrude farther left and right than the upper part 71 of the wall 61 and are connected to the retaining pieces 62. When the detector 60 is at the detection position, the left and right ends of the lower part 72 of the wall 61 are fit in the grooves 25 of the side walls 22. As shown in FIG. 3, the lower part 72 of the wall 61 has a rib-like fitting projecting piece 65 extending along the vertical direction in a laterally intermediate part of a front surface.

The retaining pieces 62 are deflectable in and out (left and right) with base parts connected to left and right ends of the wall 61 as fulcrums. As shown in FIG. 8, the retaining pieces 62 are fit into the grooves 25 of the side walls 22. The retaining pieces 62 include claw-like retaining projections 66 projecting out on front end parts. The retaining projections 66 of the retaining pieces 62 are inserted into the retaining grooves 26 of the side walls 22 and locked to face the retaining surfaces 27 at the standby position.

The locking piece 63 is vertically deflectable with a base connected to a laterally intermediate part of the wall 61 as a fulcrum. As shown in FIG. 4, the front end of the locking piece 63 is arranged in front of the front ends of the retaining pieces 62. As shown in FIG. 9, a lateral dimension of the locking piece 63 corresponds to a lateral distance between the links 31 of the frame 33. Two recessed grooves 67 are formed on both left and right sides of the upper surface of the locking piece 63 and extend in the front-rear direction. The ridges 39 of the releasing portion 35 are insertable into the recessed grooves 67 of the locking piece 63.

As shown in FIG. 7, a rear part 73 of the locking piece 63 extends straight forward from the wall 61. The rear part 73 of the locking piece 63 is connected to the upper end of the fitting projecting piece 65. A lightening portion 68 is provided by recessing the lower surface of the rear part 73 of the locking piece 63.

Figure 5:
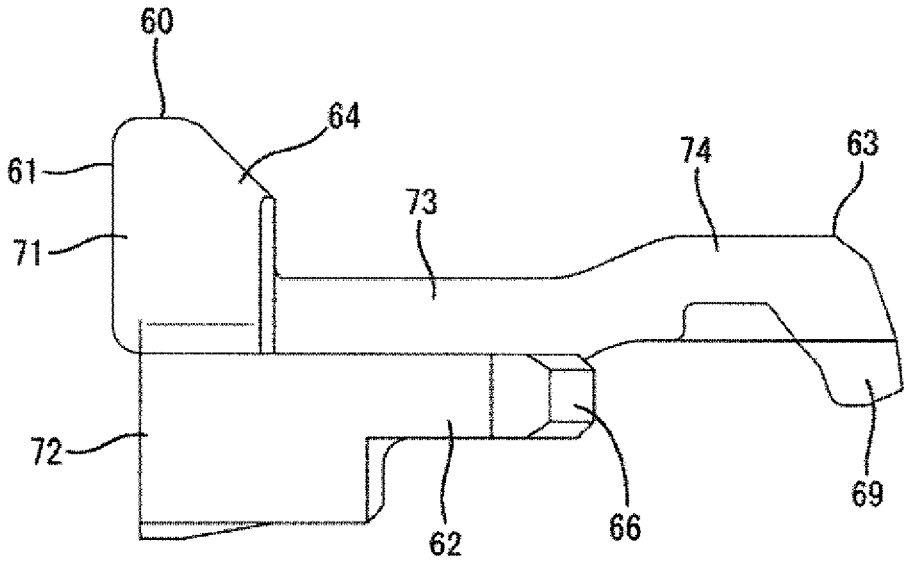
FIG. 5 is a side view of the detecting member.

A front part 74 of the locking piece 63 has a part arranged higher than the rear part 73. As shown in FIG. 9, a vertical distance between the upper surface of the front part 74 and the lower surface of the rear part 73 in the locking piece 63 corresponds to that between the releasing portion 35 and the stopper 34 in the frame 33. As shown in FIG. 5, the front part 74 of the locking piece 63 includes a claw-like locking projection 69 projecting down from a tip. The front part 74 of the locking piece 63 is curved up in a side view.

<Mating Housing 90>

The mating housing 90 is made of synthetic resin and is fixed to a device of an unillustrated vehicle. As shown in FIG. 6, the mating housing 90 includes the tubular receptacle 91 projecting forward. A lock protrusion 92 projects on the upper surface of the receptacle 91.

<Connector Connecting and Separating Operations>

Prior to connection of the connector, the detector 60 is assembled with the housing 10 from behind. In an assembling process, the retaining projections 66 of the retaining pieces 62 slide in contact with the inner surfaces of the grooves 25 of the side walls 22, the retaining pieces 62 are deflected and deformed inward and the locking piece 63 is inserted into the insertion hole 36 from behind. The ridges 39 of the releasing portion 35 are inserted into the recessed grooves 67 of the locking piece 63. When the locking projection 69 of the locking piece 63 comes out from the frame 33, the wall 61 is placed on a rear part of the upper surface of the housing body 11. Thereafter, the retaining pieces 62 resiliently return and, as shown in FIG. 8, the retaining projections 66 of the retaining pieces 62 face and are lockable to the retaining surfaces 27 of the retaining grooves 26. Further, as shown in FIG. 7, the locking projection 69 of the locking piece 63 faces and is lockable to the locking portion 30 of the arm body 29 from behind. In this way, the detector 60 is held at the standby position with respect to the housing 10 with movement in the front-rear direction restricted. At the standby position, the front part 74 of the locking piece 63 is located in front of the frame 33 and an upper surface of the front part 74 of the locking piece 63 is at a height to overlap the releasing portion 35 in the vertical direction.

Subsequently, the receptacle 91 of the mating housing 90 is inserted into the fitting space 15 of the housing 10. In the process of connecting the housings 10, 90, the lock protrusion 92 interferes with the locking portion 30 and the lock arm 14 is deflected and deformed with the both legs 28 as fulcrums. The lock protrusion 92 slides on the lower surface of the locking portion 30. When the housings 10, 90 are connected properly, the lock arm 14 resiliently returns and the lock protrusion 92 is inserted into the insertion hole 36 of the arm body 29 from below. The lock protrusion 92 faces and is lockable to the locking portion 30 from the side of the insertion hole 36 to hold the housings 10, 90 in a connected state.

Further, as the lock protrusion 92 is inserted into the insertion hole 36, the locking projection 69 is pressed by the lock protrusion 92 to be displaced up. In this way, the locking of the locking projection 69 and the locking portion 30 is released and the detector 60 becomes movable forward toward the detection position.

Subsequently, the upper part 71 of the wall 61 is held with fingers and the detector 60 is pushed forward. In the process of moving the detector 60, the wall 61 slides in contact with the upper surface of the housing body 11 and the retaining pieces 62 slide in contact with the inner surfaces of the grooves 25 of the side walls 22. Further, in the process of moving the detector 60, the rear part 73 of the locking piece 63 is displaced in the frame 33, the front part 74 of the locking piece 63 is deflected and deformed and the locking projection 69 slides in contact with the upper surface of the locking portion 30. When the detector 60 reaches the detection position, the locking piece 63 resiliently returns and, as shown in FIG. 6, the locking projection 69 faces and is lockable to the front surface of the locking portion 30.

At the detection position, the lower part 72 of the wall 61 is in contact with the stopper 34, the fitting projecting piece 65 is inserted in the recess 37 and the projecting pieces 64 face the outer surfaces of the links 31 to embrace the frame 33. A movement of the detector 60 farther forward than the detection position is restricted by the contact of the lower part 72 of the wall 61 with the stopper 34. Further, at the detection position, a forward movement of the detector 60 is restricted also by the upper part 71 of the wall 61 arranged to face the rear end of the releasing portion 35 and the retaining projections 65 of the retaining pieces 62 face the rear ends of the protruding portions 32. The upper part 71 of the wall 61 has a part arranged to face the rear end of the protrusion 38 and be higher than the releasing portion 35.

As described above, the detector 60 is movable to the detection position when the housings 10, 90 are in a properly connected state. On the other hand, if the housings 10, 90 do not reach the properly connected state, the lock protrusion 92 is not inserted into the insertion hole 36 and the locking of the locking projection 69 and the locking portion 30 is maintained. Thus, even if a forward pushing force is applied to the detector 60, the detector 60 cannot be moved to the detection position. Thus, it can be detected that the housings 10, 90 are in the properly connected state if the detector 60 becomes movable to the detection position.

On the other hand, in separating the housings 10, 90 for maintenance or other reason, the upper part 71 of the wall 61 is pulled strongly rearward. Then, the locking projection 69 rides over the locking portion 30 and the detector 60 is returned to the standby position while the locking piece 63 is deflected. The locking projection 69 rides on the lock protrusion 92 and the front part 74 of the locking piece 63 is deflected and deformed.

Subsequently, a pressing force is applied to the releasing portion 35 from above. Then, the lock arm 14 is deflected with the legs 28 as fulcrums, and the front of the arm body 29 is displaced upward. In this way, the locking projection 69 disengages the locking portion 30. In that state, the housings 10, 90 are pulled apart from each other in separating directions.

On the other hand, even if a pressing force is applied to the detector 60 from above, the locking of the locking projection 69 and the locking portion 30 is not released since the lock arm 14 is not interlocked with the detector 60. Here, an external matter comes into contact with the upper end surface of the wall 61 that is taller than the lock arm 14 in the detector 60 and is hindered from reaching a position where the external matter contacts the releasing portion 35. Thus, the locking of the locking projection 69 and the locking portion 30 is not released inadvertently by interference with external matter.

As described above, according to this embodiment, the detector 60 slides in contact with a part of the housing 10 other than the lock arm 14 to be guided during a movement. Thus, the lock arm 14 is less affected by the detector 60 as compared to the case where a structure for guiding a movement of the detector 60 is provided on the lock arm 14. As a result, an inadvertent movement of the lock arm 14 can be prevented during a movement of the detector 60, and a locking state of the lock arm 14 and the lock protrusion 92 can be maintained satisfactorily. The lock arm 14 has the frame 33 including the releasing portion 35, the stopper 34 and the two links 31, and the locking piece 63 of the detector 60 is inserted into the insertion hole 36 constituting the inside of the frame 33. Thus, the strength of the rear part of the lock arm 14 is sufficient and the lock arm 14 will not inadvertently deflect and deform. As a result, the lock reliability of the lock arm 14 is ensured.

The releasing portion 35 of the frame 33 is pressed to separate the housings 10, 90, and the stopper 34 restricts movement of the detector 60 by being contacted by the detector 60 at the detection position. Further, the links 31 link the releasing portion 35 and the stopper 34. Thus, the structure of the housing 10 is simpler and the connector can be smaller than if a reinforcing portion merely is provided to ensure the strength of the lock arm 14. Especially, since the frame 33 has a quadrilateral cross-section, the strength of the lock arm 14 is further improved.

The stopper 34 functions to contact and stop the detector 60 at the detection position and also functions to reinforce the strength of the stopper 34 itself and the legs 28 by being connected to the legs 28 of the lock arm 14. Thus, the structure of the housing 10 is even simpler.

Furthermore, the detector 60 includes the wall 61 at the position side by side with the releasing portion 35 in the front-rear direction and the wall 61 has the upper end surface higher than the releasing portion 35 in the vertical direction. Thus, external matter contact with upper end surface of the wall 61 so that the releasing portion 35 is prevented from contact of the external matter to ensure that the locked state of the lock arm 14 is not released inadvertently.

The embodiment disclosed is illustrative in all aspects and not restrictive.

For example, although the frame 33 has a quadrilateral cross-section in the above embodiment, a frame may have a circular cross-section or a polygonal cross-section other than a quadrilateral cross-section as another embodiment.

Although the frame 33 is provided only on the rear end part of the lock arm 14 in the above embodiment, a frame may be provided over the entire length of a lock arm or may be provided on an intermediate part of the lock arm in a front-rear direction as another embodiment.

Although the detector 60 is moved manually to the detection position in the above embodiment, a detector may be moved automatically to a detection position by a biasing member, such as a coil spring as another embodiment.

LIST OF REFERENCE SIGNS

10 housing
11 housing body (body part)
12 fitting tube
13 coupling
14 lock arm
15 fitting space
16 cavity
17 locking lance
18 flange
19 mounting groove
20 sealing member
21 front retainer
22 side wall
23 upper wall
24 stepped portion
25 groove
26 retaining groove
27 retaining surface
28 leg
29 arm body
30 locking portion
31 link
32 protruding portion
33 frame
34 stopper
35 releasing portion
36 insertion hole
37 recess
38 protrusion
39 ridge
60 detector
61 wall
62 retaining piece
63 locking piece
64 projecting piece
65 fitting projecting piece
66 retaining projection
67 recessed groove
68 lightening portion
69 locking projection
71 upper part (of wall)
72 lower part (of wall)
73 rear part (of locking piece)
74 front part (of locking piece)
90 mating housing
91 receptacle
92 lock protrusion

What is claimed is:

1. A connector, comprising:

a housing connectable to a mating housing;

a deflectable lock arm provided on the housing, the lock arm locking the mating housing in a connected state; and a detector arranged movably between a standby position and a detection position with respect to the housing, the detector being allowed to move from the standby position to the detection position after the housings are connected, wherein:

the detector includes a locking piece to be locked to the lock arm at the standby position before the housings are connected, and the lock arm includes:

a releasing portion to be pressed at the time of separating the housings;

a stopper contactable by the detector having reached the detection position at a position facing the releasing portion;

two links linking the releasing portion and the stopper and facing each other; and an insertion hole formed inside the releasing portion (35), the stopper and the links, the locking piece being inserted into the insertion hole.

2. The connector of claim 1, wherein the releasing portion, the stopper and the links define a quadrilateral frame surrounding the insertion hole.

3. The connector of claim 2, wherein the lock arm includes a leg rising from a body part of the housing, and the stopper is connected to the leg.

4. The connector of claim 3, wherein the detector slides in contact with a part of the housing other than the lock arm to guide a movement of the detector.

5. The connector of claim 4, wherein:

the detector includes a wall at a position side by side with the releasing portion in a moving direction from the standby position to the detection position, and the wall has an end surface at a position higher than the releasing portion in a height direction intersecting the moving direction.

6. The connector of claim 1, wherein the lock arm includes a leg rising from a body part of the housing, and the stopper is connected to the leg.

7. The connector of claim 1, wherein the detector slides in contact with a part of the housing other than the lock arm to guide a movement of the detector.

8. The connector of claim 1, wherein:

the detector includes a wall at a position side by side with the releasing portion in a moving direction from the standby position to the detection position, and the wall has an end surface at a position higher than the releasing portion in a height direction intersecting the moving direction.

* * * * *